US007544302B2

(12) United States Patent
Harding

(10) Patent No.: US 7,544,302 B2
(45) **Date of Patent: *Jun. 9, 2009**

(54) METHOD AND APPARATUS FOR REMOVING CUTTINGS FROM DRILLING FLUIDS

(76) Inventor: Darin Merle Harding, P.O. Box 1324, Grande Prairie, Alberta (CA) T8V 4Z1

( * ) Notice: Subject to any disclaimer, the term of this patent is extended or adjusted under 35 U.S.C. 154(b) by 41 days.

This patent is subject to a terminal disclaimer.

(21) Appl. No.: 11/604,098

(22) Filed: Nov. 24, 2006

(65) Prior Publication Data

US 2007/0125545 A1 Jun. 7, 2007

Related U.S. Application Data

(63) Continuation-in-part of application No. 10/983,964, filed on Nov. 8, 2004, now Pat. No. 7,072,451.

(51) Int. Cl.
*B01D 21/02* (2006.01)

(52) U.S. Cl. ..... 210/801; 210/803; 210/519; 210/521; 210/523; 210/532.1

(58) Field of Classification Search ..... 210/712, 210/801, 803, 804, 195.1, 207, 259, 519, 210/521, 523, 532.1, 540; 428/119, 136, 428/174, 177

See application file for complete search history.

(56) References Cited

U.S. PATENT DOCUMENTS 1,044,845 A * 11/1912 Argall ..... 210/523
1,732,386 A * 10/1929 Sprockhoff ..... 210/523
2,118,157 A * 5/1938 Camp ..... 210/519
3,015,621 A * 1/1962 Quast ..... 210/519
4,042,512 A * 8/1977 McCarthy et al. ..... 210/521
4,059,529 A * 11/1977 McGivern ..... 210/519
4,722,800 A * 2/1988 Aymong ..... 210/519
4,824,062 A * 4/1989 Wagner ..... 248/265
5,186,821 A * 2/1993 Murphy ..... 210/519
5,204,000 A * 4/1993 Steadman et al. ..... 210/519
5,807,618 A * 9/1998 Shiota et al. ..... 428/119
5,814,230 A * 9/1998 Willis et al. ..... 210/804
6,059,977 A * 5/2000 Rowney et al. ..... 210/712
6,077,448 A * 6/2000 Tran-Quoc-Nam et al. .. 210/521
6,099,743 A * 8/2000 Pedersen ..... 210/519
6,391,195 B1 * 5/2002 Layton ..... 210/519
6,736,275 B2 * 5/2004 Schneider et al. ..... 210/519
6,800,209 B2 * 10/2004 Wright ..... 210/801

(Continued)

*Primary Examiner*—Christopher Upton

(57) ABSTRACT

A method and apparatus for recycling drilling fluids used in the drilling of wells is provided. The apparatus comprises a tank with a plurality of compartments. Used drilling fluid containing well cuttings or "solids" is pumped into a receiving compartment of the tank and directed towards a flow-reversing barrier. Reversal of the flow causes heavier solids to settle to the bottom of the tank. As fluid fills the receiving compartment, it flows downstream into an adjacent compartment by passing through a flow-restricting baffle that causes more solids to settle to the bottom of the tank. As fluid overflows from compartment to compartment in the tank, it passes through successive flow-restricting baffles causing further solids to settle to the bottom of the tank. Fluid is removed from the collecting compartment of the tank to be used again in drilling operations. A conveyor extending along the bottom of the tank is used to move the settled solids through an outlet that can be passed through a centrifuge to recover residual fluids.

35 Claims, 8 Drawing Sheets

U.S. PATENT DOCUMENTS 6,808,626 B2 * 10/2004 Kulbeth ..... 210/804
6,997,328 B2 * 2/2006 Wilcher et al. ..... 210/519
7,060,179 B1 * 6/2006 Batten et al. ..... 210/538
2006/0196827 A1 * 9/2006 Liao ..... 210/521

* cited by examiner

Figure 3
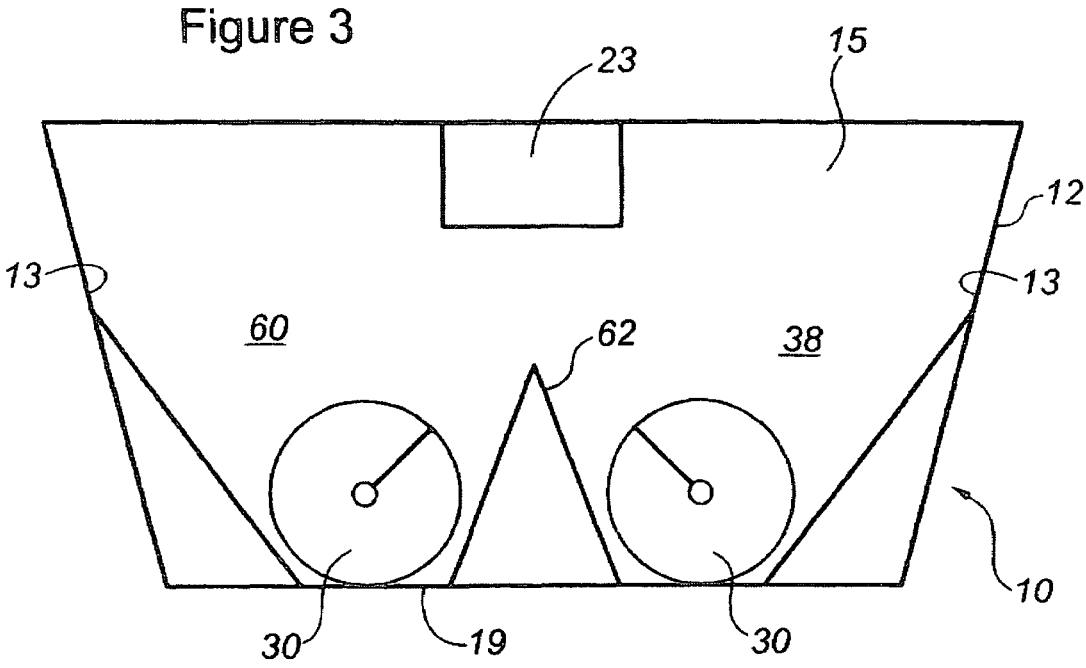
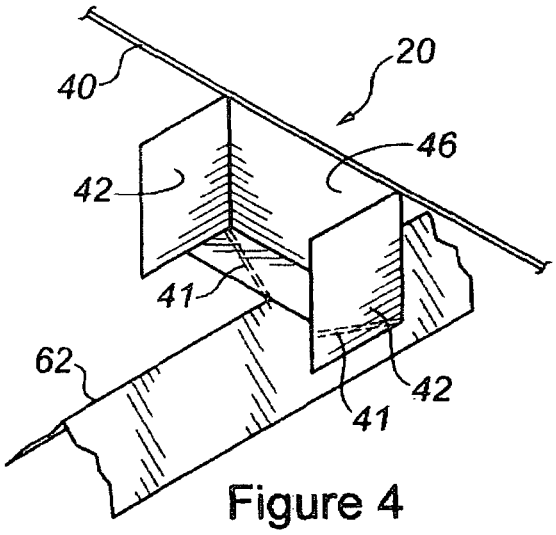
Figure 4
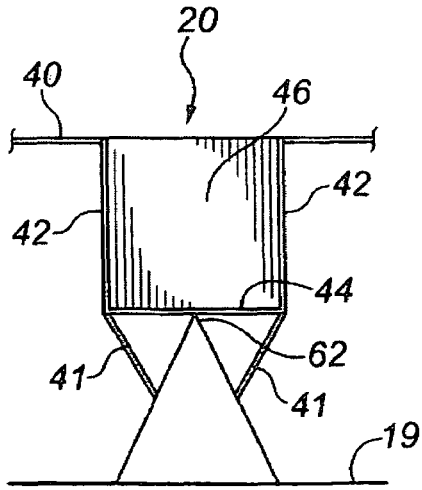
Figure 5

Figure 6
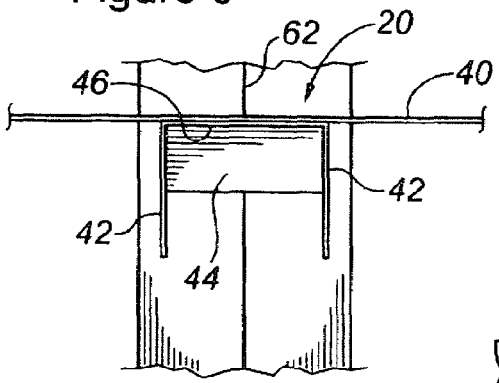
Figure 7
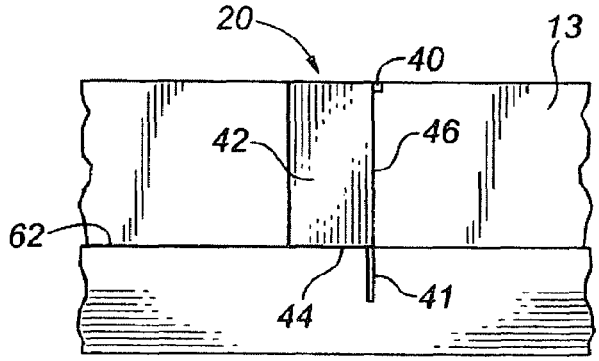
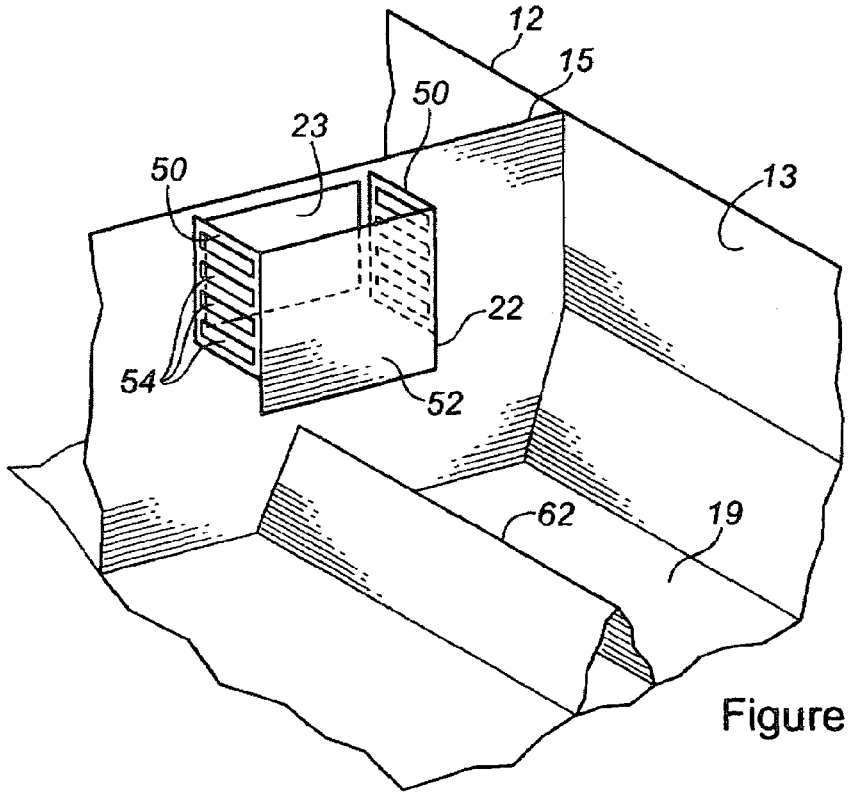
Figure 8

METHOD AND APPARATUS FOR REMOVING CUTTINGS FROM DRILLING FLUIDS

This application is a continuation-in-part of U.S. patent application Ser. No. 10/983,564 filed for Darin Merle Harding on 8 Nov. 2004 now U.S. Pat. No. 7,072,451.

FIELD OF INVENTION

The present invention relates to a method and apparatus for recycling drilling fluids used in the drilling of wells.

BACKGROUND

The drilling of wells in the recovery of oil and gas is typically done with a hollow drill string. As the well is being drilled, drilling fluids are pumped down the bore of the string. The drilling fluid passes through openings in the drill bit and returns to the surface through the annulus surrounding the string, carrying the cuttings produced by the drill bit. The drilling fluids can then be recycled to remove the cuttings so that they may be used again.

Traditional methods of recycling drilling fluid include using a centrifuge to separate the liquid from the cuttings. In large drilling operations, to keep up with the volume of drilling fluid used, it is necessary to use either a very large centrifuge or to use a multitude of centrifuges. In either case, the costs of operating such a drilling fluid recycling system are substantial.

It is known to use a settling tank in combination with a centrifuge in a fluid recycling system. The settling tank is used as a preliminary step to settle the cuttings from the fluid. The cuttings often remain in suspension in the fluid and are often referred to as "solids". Flocculating agents may be introduced into the tank to assist in the settling of solids. The drilling fluids are pumped into the receiving end of the tank. A typical settling tank may have a plurality of transverse walls or baffles that form a plurality of compartments within the tank. Each wall can have an opening to permit the flow of fluid from an upstream compartment to a downstream compartment. As fluid flows from compartment to compartment, solids in the fluid settle to the bottom of the tank.

Once fluid reaches the collecting end of the tank, it is withdrawn from the tank to be used in the drilling operation. The settled solids are conveyed towards the receiving end of the tank using an auger. A slurry of settled solids and fluid are withdrawn from the tank and pumped through a centrifuge. Fluid recovered from the centrifuge is re-introduced into the tank at the receiving end.

While using the combination of settling tank and centrifuge is an improvement in comparison to using a centrifuge by itself in practice, this circuit is often unable to keep up with the throughput of drilling fluid required in drilling a well. It is often necessary to temporarily halt drilling of the well until the settling tank and centrifuge can catch up and recover enough drilling fluid to commence drilling operations again.

It is, therefore, desirable to provide a settling tank that overcomes the shortcomings of the prior art and provides a method and apparatus that is capable of recycling drilling fluid in sufficient quantity for typical drilling operations.

SUMMARY OF THE INVENTION

A method and apparatus for recycling drilling fluids used in the drilling of wells is provided.

In one embodiment, the apparatus comprises a tank whose interior space is sub-divided into a plurality of compartments.

Transverse walls are located within the tank, spaced approximately equidistant apart along the length of the tank to define the compartments of the tank. At one end of the tank, there is a receiving compartment. At the other end, there is a collecting compartment. A flow-reversing barrier located in the receiving compartment. In one embodiment, the barrier comprises a vertical rectangular back panel with two vertical rectangular side panels extending perpendicular from the back panel to form a U-shaped structure. A bottom rectangular plate extends from the back panel partway along the bottom edges of the side panels, partially enclosing the bottom of the barrier.

In each of the transverse walls, there is an opening in the upper end of the wall that enables fluid to flow from an upstream compartment into an adjacent downstream compartment. In another embodiment, the settling tank can have a flow-restricting baffle mounted on the downstream side of each transverse wall, aligned with the opening. The baffle comprises a vertical rectangular back plate with two vertical rectangular side walls that extend perpendicular from the back plate to form a U-shaped structure. The baffle attaches to the wall on either side of the opening. The top edges of the plate and side walls are substantially aligned with the top of the transverse wall whereas the bottom edge of the plate can extend lower into the compartment than the side walls. Each baffle side wall can also have a plurality of openings or slots.

The bottom wall of the tank forms at least one trough that runs lengthwise along the tank, passing through each of the compartments. There is a conveyor in each trough for moving solids towards the collecting compartment. In one embodiment of the apparatus, there are four compartments and two troughs running along the bottom of the tank, each trough comprising an auger. The augers move solids towards an outlet located on an end wall of the tank. In one embodiment, the outlet is located on the collecting compartment end of the tank. In another embodiment, the outlet is located on the receiving compartment end of the tank.

The method of recycling drilling fluid comprises the steps of pumping drilling fluid containing solids into the receiving compartment and directing the fluid towards the flow-reversing barrier. As the fluid strikes the barrier, the fluid stops and reverses its flow in order to flow around the side panels of the barrier. This causes heavier solids within the fluid settle to the bottom of the tank.

As fluid fills the receiving compartment, the level of the fluid will rise to the opening in the transverse wall separating the receiving compartment from the adjacent downstream compartment. Fluid flowing through the opening encounters the flow-restricting baffle where it passes through the slots in the side walls and the bottom opening of the baffle. This causes solids in the fluid to settle to the bottom of the tank.

As fluid flows from compartment to compartment, it passes through subsequent baffles in each transverse wall opening until the fluid reaches the collecting compartment. By the time the fluid reaches the collecting compartment, substantially all of the solids in the fluid have settled to the bottom of the tank. Fluid is then removed from the collecting department to be used again in the drilling operations.

The settled solids are moved towards the collecting compartment by an auger in each trough. The augers expel a mixture or slurry of solids and fluid through outlets on an end wall of the tank. In a further embodiment, the slurry is pumped through a centrifuge. The residual fluid in the mixture is removed by the centrifuge and introduced back into the receiving compartment of the tank.

In another embodiment, a flocculating chemical agent may also be used to assist in settling solids from the drilling fluid.

In this embodiment, drilling fluid can be skimmed from the collecting compartment and mixed with a flocculating chemical. The mixture is pumped into the receiving compartment and mixes with the received drilling fluid.

Broadly stated, one aspect of an apparatus for removing solids from drilling fluid comprises: a settling tank having first and second end walls, two side walls extending between the end walls and a bottom comprising at least one v-shaped trough running lengthwise between the end walls, the trough adapted to collect solids settled from the fluid, the tank forming a receiving compartment adjacent to the first end wall, a collecting compartment adjacent to the second end wall, and an outlet; barrier means for reversing the flow of a stream of drilling fluid containing solids received in the receiving compartment, said barrier means disposed in the receiving compartment and adapted to cause said stream to reverse direction and flow around said barrier means thereby causing at least some of the solids contained in the fluid to settle to the bottom of the tank; a wall transversely mounted in the tank between the side walls, the transverse wall separating the receiving and collecting compartments, the wall defining an aperture for allowing the fluid to pass through as the fluid flows in a first direction from the receiving compartment to the collecting compartment; and a material conveyor for moving the settled solids at the bottom of the tank towards the outlet.

Broadly stated, another aspect of an apparatus for removing solids from drilling fluid comprises: a settling tank having first and second end walls, two side walls extending between the end walls and a bottom enclosing the area defined by the bottom edges of the end walls and the side walls, the tank forming a receiving compartment adjacent to the first end wall, a collecting compartment adjacent to the second end wall, and an outlet; a wall transversely mounted in the tank between the side walls, the wall separating the receiving and collecting compartments, the wall defining an aperture having a flow-restricting baffle, the baffle extending perpendicular from the wall towards the collecting compartment, the baffle capable of causing at least some of the remaining solids contained in the fluid to settle to the bottom of the tank as fluid flows in a first direction from the receiving compartment to the collecting compartment and passes through the aperture and baffle; and a material conveyor for moving the settled solids at the bottom of the tank towards the outlet.

Broadly stated, one aspect of a flow-reversing barrier for removing solids from drilling fluids in a settling tank having first and second end walls, two side walls extending therebetween and a bottom, said tank forming a receiving compartment for receiving a stream of drilling fluid containing solids adjacent to the first end wall and a collecting compartment adjacent to the second end wall comprises: a substantially vertical back panel; a pair of side panels extending from the side edges of the back panel; a bottom plate extending from the bottom edge of the back panel, the bottom plate extending between the side panels; and means for mounting said barrier in a receiving compartment of a settling tank whereby said barrier is positioned to receive said stream between said side panels towards said back panel thereby causing said stream to reverse direction and flow around said barrier thereby causing at least some of the solids to settle to the bottom of the tank.

Broadly stated, one aspect of a flow restricting baffle for removing solids from drilling fluids in a settling tank, said tank having at least one wall transversely mounted between side walls of the said tank, the wall separating a receiving compartment from a collecting compartment, the wall having an aperture to allow drilling fluid to pass through as the fluid flows in a first direction from the receiving compartment to the collecting compartment comprises: a substantially vertical back plate; and a pair of spaced-apart side walls extending from the side edges of the back plate, said side walls adapted to be attached to the transversely mounted wall of said settling tank and straddle said aperture said baffle adapted of causing at least some of the solids contained in the drilling fluid to settle to the bottom of the tank as the fluid flows in the first direction through said aperture.

Broadly stated, one aspect of a kit for a settling tank for removing solids from drilling fluids having first and second end walls, two side walls extending therebetween and a bottom, the tank forming a receiving compartment for receiving a stream of drilling fluid containing solids adjacent to the first end wall and a collecting compartment adjacent to the second end wall, the tank having at least one wall transversely mounted between the side walls separating the receiving and collecting compartments, the transverse wall defining an aperture for allowing drilling fluid to pass through as the drilling fluid flows in a first direction from the receiving compartment to the collecting compartment comprises one or more components selected from the group consisting of: a flow-reversing barrier comprising a substantially vertical back panel, a pair of side panels extending from the side edges of the back panel, a bottom plate extending from the bottom edge of the back panel, the bottom plate extending between the side panels, and means for mounting said barrier in the receiving compartment such that said barrier is positioned to receive said stream directed between said side panels towards said back panel thereby causing said stream to reverse direction and flow around said barrier whereby at least some of the solids contained in the drilling fluid settle to the bottom of the tank; and a flow-restricting baffle comprising a substantially vertical back plate, and a pair of spaced-apart walls extending from the side edges of the back plate, said side walls adapted to be attached to the transversely mounted wall straddling said aperture, said baffle adapted to cause at least some of the solids contained in the drilling fluid to settle to the bottom of the tank as the fluid flows in the first direction through said aperture.

Broadly stated, one aspect of a method for recycling drilling fluid containing solids comprises: directing a stream of drilling fluid containing solids into a flow-reversing barrier located in a receiving compartment of a settling tank, the settling tank further comprising a collecting compartment, the collecting compartment separated from the receiving compartment by a transverse wall, the wall defining an aperture, the flow-reversing barrier capable of causing the stream to reverse direction and flow around the barrier thereby causing at least some of the solids contained in the fluid to settle to the bottom of the tank; allowing the stream of fluid to fill the receiving compartment and pass through the aperture of the transverse wall as the fluid flows in a first direction from the receiving compartment to the collecting compartment; allowing the fluid to flow in the first direction and fill the collecting compartment; extracting fluid from the collecting compartment for re-use in drilling operations; moving the settled solids on the bottom of the tank towards an outlet; and removing a mixture of fluid and solids from the outlet.

Broadly stated, another aspect of a method for recycling drilling fluid containing solids comprises: directing a stream of drilling fluid containing solids into a receiving compartment of a settling tank, the settling tank further comprising a collecting compartment, the collecting compartment separated from the receiving compartment by a transverse wall, the wall defining an aperture with a flow-restricting baffle attached thereto; allowing the stream of fluid to fill the receiving compartment and pass through the aperture and flow-restricting baffle of the transverse wall as the fluid flows in a first direction from the receiving compartment to the collecting compartment, the flow-restricting baffle capable of causing at least some of the solids contained in the fluid to settle to the bottom of the tank as the fluid flows through the aperture and baffle; allowing the fluid to flow in the first direction and fill the collecting compartment; extracting fluid from the collecting compartment for re-use in drilling operations; moving the settled solids on the bottom of the tank towards an outlet; and removing a mixture of fluid and solids from the outlet.

Broadly stated, another aspect of a method for recycling drilling fluid containing solids comprises: directing a stream of drilling fluid containing solids into a flow-reversing barrier located in a receiving compartment of a settling tank, the settling tank further comprising a collecting compartment, the collecting compartment separated from the receiving compartment by a transverse wall, the wall defining an aperture with a flow-restricting baffle attached thereto, the flow-reversing barrier capable of causing the stream to reverse direction and flow around the barrier thereby causing at least some of the solids contained in the fluid to settle to the bottom of the tank; allowing the stream of fluid to fill the receiving compartment and pass through the aperture and flow-restricting baffle of the transverse wall as the fluid flows in a first direction from the receiving compartment to the collecting compartment, the flow-restricting baffle capable of causing at least some of the remaining solids contained in the fluid to settle to the bottom of the tank as the fluid flows through the aperture and baffle; allowing the fluid to flow in the first direction and fill the collecting compartment; extracting fluid from the collecting compartment for re-use in drilling operations; moving the settled solids on the bottom of the tank in a second direction opposite the first direction towards an outlet located in the receiving compartment; and removing a mixture of fluid and solids from the outlet.

Broadly stated, one aspect of an apparatus for removing solids from drilling fluid comprises: a settling tank having first and second end walls, two side walls extending between the end walls and a bottom enclosing the area defined by the bottom edges of the end walls and the side walls, the tank forming a receiving compartment adjacent to the first end wall and a collecting compartment adjacent to the second end wall, the first end wall defining an outlet; a flow-reversing barrier mounted in the receiving compartment, the barrier adapted to receive a stream of drilling fluid containing solids, the barrier capable of causing the stream to reverse direction and flow around the barrier thereby causing at least some of the solids contained in the fluid to settle to the bottom of the tank; a wall transversely mounted in the tank between the side walls, the wall separating the receiving and collecting compartments, the wall defining an aperture having a flow-restricting baffle, the baffle extending perpendicular from the wall towards the collecting compartment, the baffle capable of causing at least some of the remaining solids contained in the fluid to settle to the bottom of the tank as fluid flows in a first direction from the receiving compartment to the collecting compartment and passes through the aperture and baffle; and a material conveyor for moving the settled solids at the bottom of the tank towards the outlet on the first end wall.

BRIEF DESCRIPTION OF THE DRAWINGS

FIG. 3 is a cross-sectional end view depicting the settling tank of FIG. 2*a* along section lines III-III.

FIG. 4 is a perspective view depicting the flow-reversing barrier of FIG. 1*a*.

FIG. 5 is a front elevational view depicting the flow-reversing barrier of FIG. 1*a*.

FIG. 6 is a top plan view depicting the flow-reversing barrier of FIG. 1*a*.

FIG. 7 is a side elevational view depicting the flow-reversing barrier of FIG. 1*a*.

FIG. 8 is a perspective view depicting the flow-restricting baffle of FIG. 1*a*.

DETAILED DESCRIPTION OF EMBODIMENTS

Figure 1A:
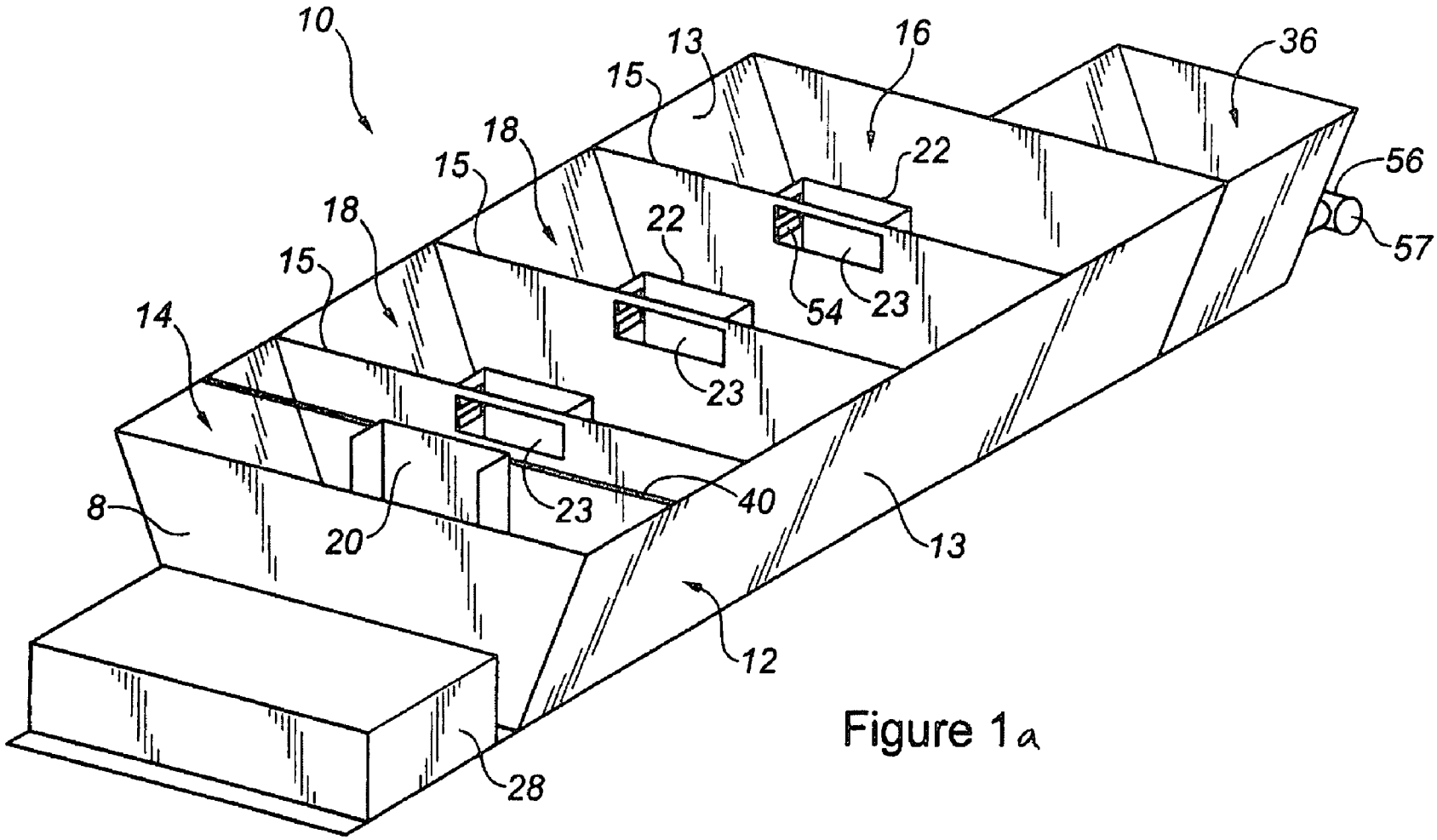
FIG. 1*a* is a perspective view depicting a settling tank having a flow-reversing barrier and flow-restricting baffles disposed on transverse walls within the tank.

A method and apparatus for recycling drilling fluids used in the drilling of wells is provided. Illustrated in FIGS. 1*a*, 1*b*, 1*c*, 2*a* and 2*b* are various embodiments of apparatus 10. Apparatus 10 includes settling tank 12 that comprises end walls 8 and 9, side walls 13 and bottom 19. In a representative embodiment, the dimensions of tank 12 are 50 feet long by 5 feet high by 10 feet wide. In another embodiment, apparatus 10 has three transverse walls 15 within tank 12 to form four compartments that are approximately 3,172 gallons in volume each for a total capacity of 12,688 gallons. One compartment defined by a transverse wall 15 is receiving compartment 14 located adjacent to end wall 8 of tank 12. Another compartment defined by a transverse wall 15 is collecting compartment 14 located adjacent to end wall 9 of tank 12. The third transverse wall 15 defines the two intermediate compartments 18 between receiving compartment 14 and collecting compartment 16. Pump 34 is located in collecting compartment 16 to withdraw fluid that has passed through tank 12 for re-use in drilling operations.

Figure 2A:
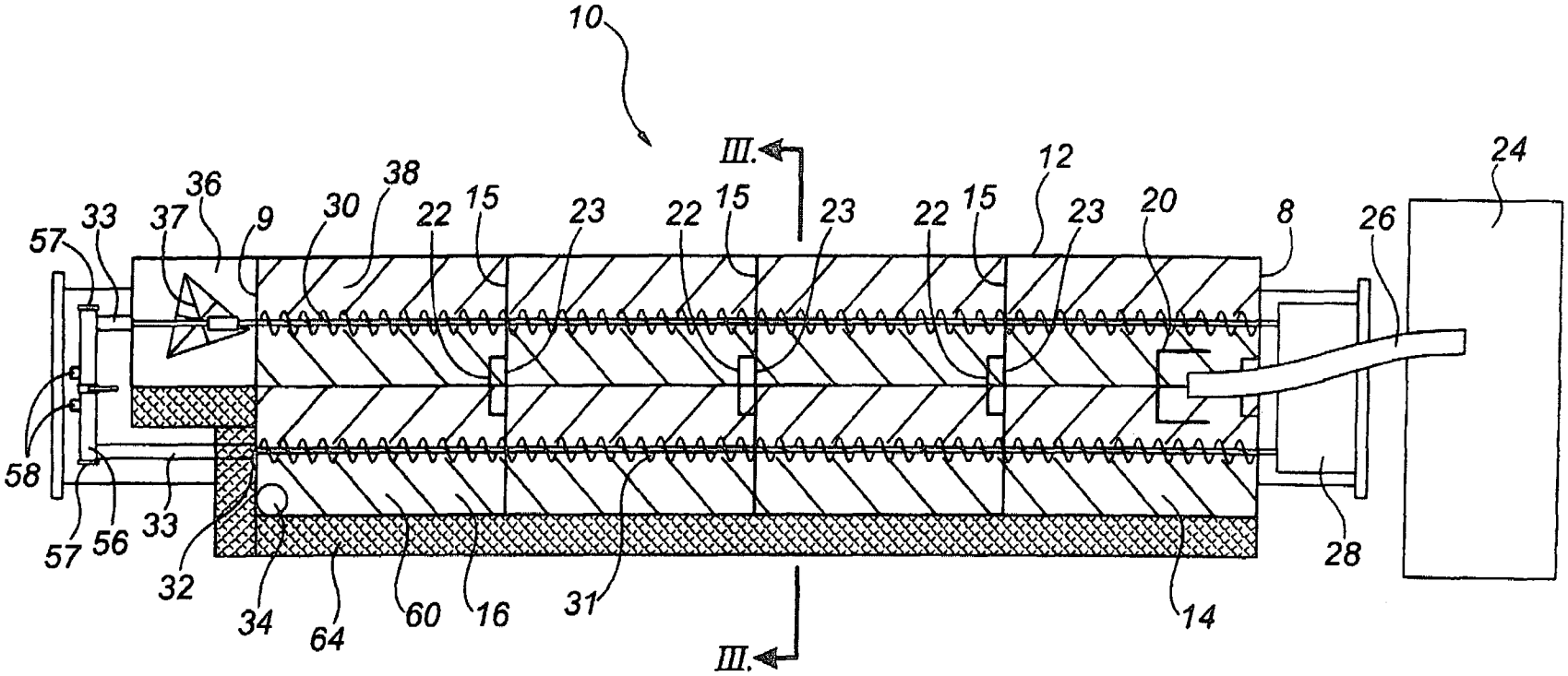
FIG. 2*a* is a top plan view depicting the settling tank of FIG. 1*a* having an auger that moves solids in the same direction as the fluid flow.

Referring to FIG. 2*a*, bottom wall 19 of tank 12 in combination with inverted V-shaped rib 62 form troughs 38 and 60 that run lengthwise along tank 12 from end wall 8 to end wall 9. In a representative embodiment, augers 30 and 31 are 10 inches in diameter and have a pitch of 10 inches. Augers 30 and 31 turn at approximately 9 revolutions per minute and are driven by drive mechanism 28. In one embodiment, drive mechanism 28 comprises of an electric motor in the 2 to 3 horsepower range coupled to a gearbox (not shown). The output of the gearbox can be coupled to one auger via a belt and pulley system (not shown). Alternatively, a chain and sprocket system can be used. To synchronize the two augers to turn at the same rate, each auger has a chain sprocket and is coupled to one another via a drive chain (not shown). It should be obvious to one skilled in the art that drive mechanism 28 may also use an internal combustion engine or a hydraulic drive system as the motive power to turn the augers. It should also be obvious that the gear ratio of the gearbox and the pulley sizes are dependent on the type of motive power used in order to obtain the desired turning rate of the augers.

Figure 1B:
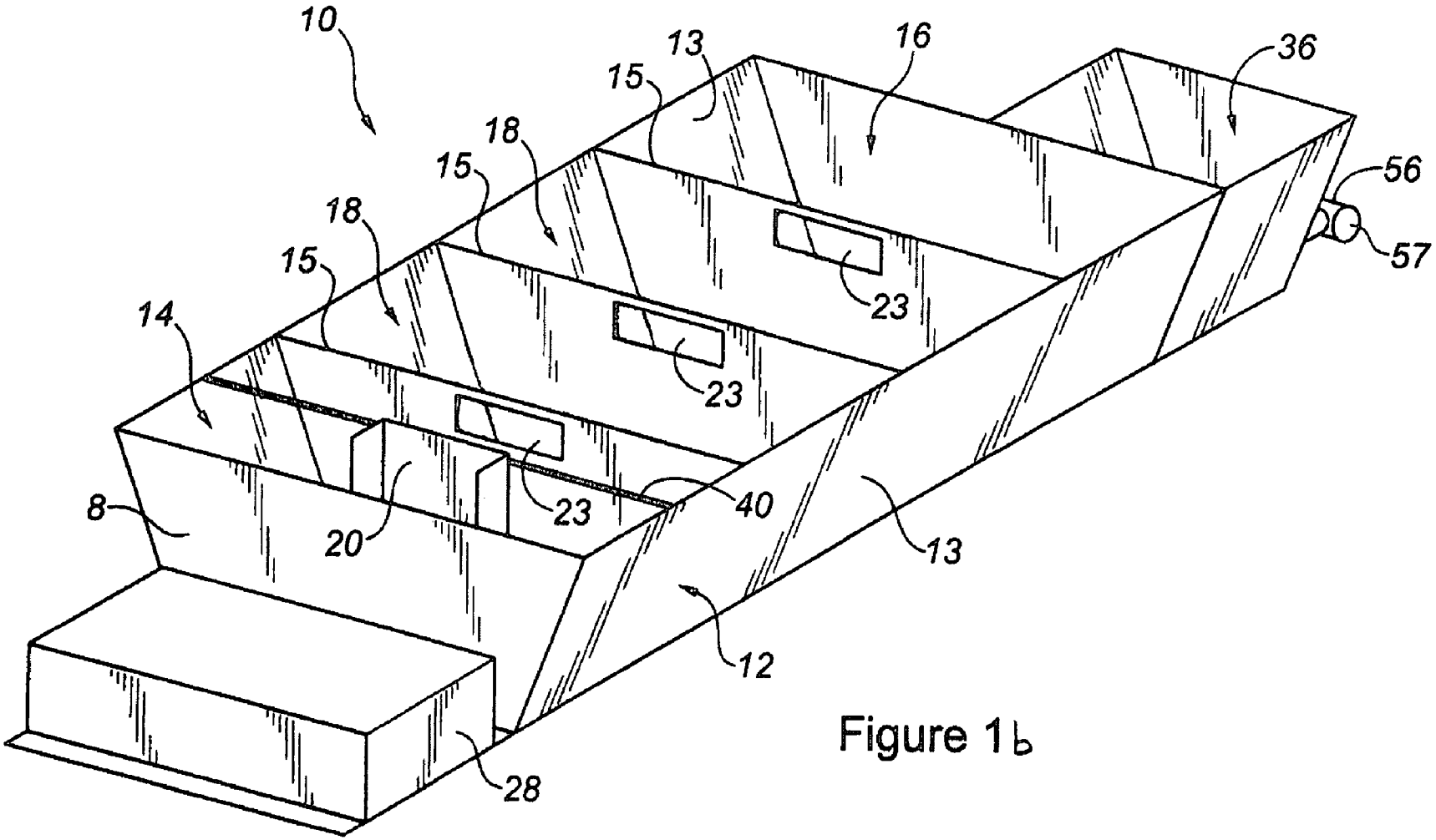
FIG. 1*b* is a perspective view depicting the settling tank of FIG. 1*a* without the flow-restricting baffles.
Figure 1C:
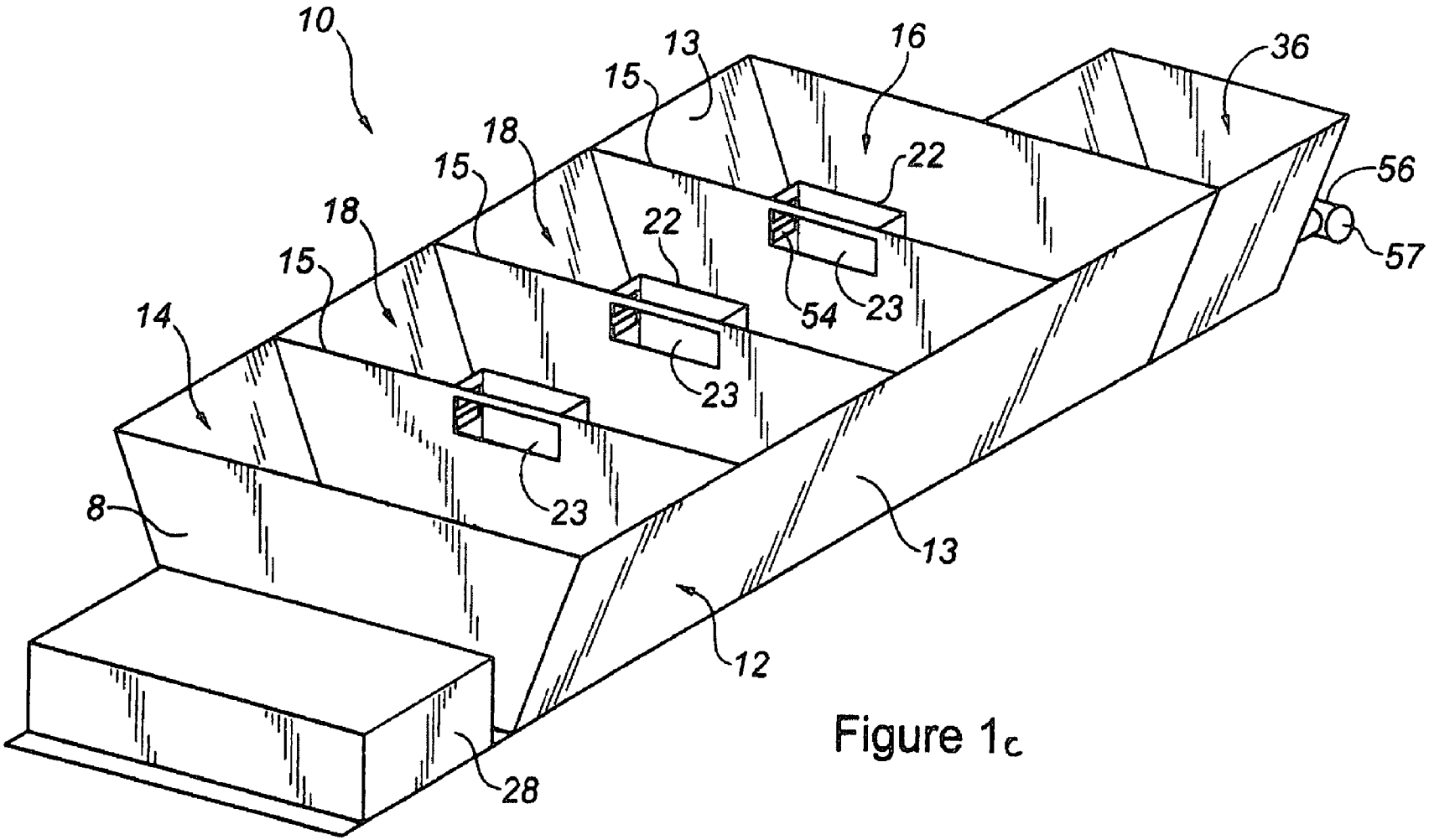
FIG. 1*c* is a perspective view depicting the settling tank of FIG. 1*a* without the flow-reversing barrier.

Referring to FIG. 1*a*, apparatus 10 is shown having flow-reversing barrier 20 mounted within receiving compartment 14 and flow-restricting baffles 22 mounted on the downstream side of apertures 23 on each of transverse walls 15. Flow-reversing barrier 20 can be constructed from sheet steel and can be mounted substantially in the centre of receiving compartment 14 as shown in FIGS. 1*a* and 1*b*. FIG. 1*b* illustrates an alternate embodiment of apparatus 10 where tank 12 does not include flow-restricting baffles 22. FIG. 1*c* illustrates a further embodiment of apparatus 10 where tank 12 does not include flow-reversing barrier 20.

Figure 2B:
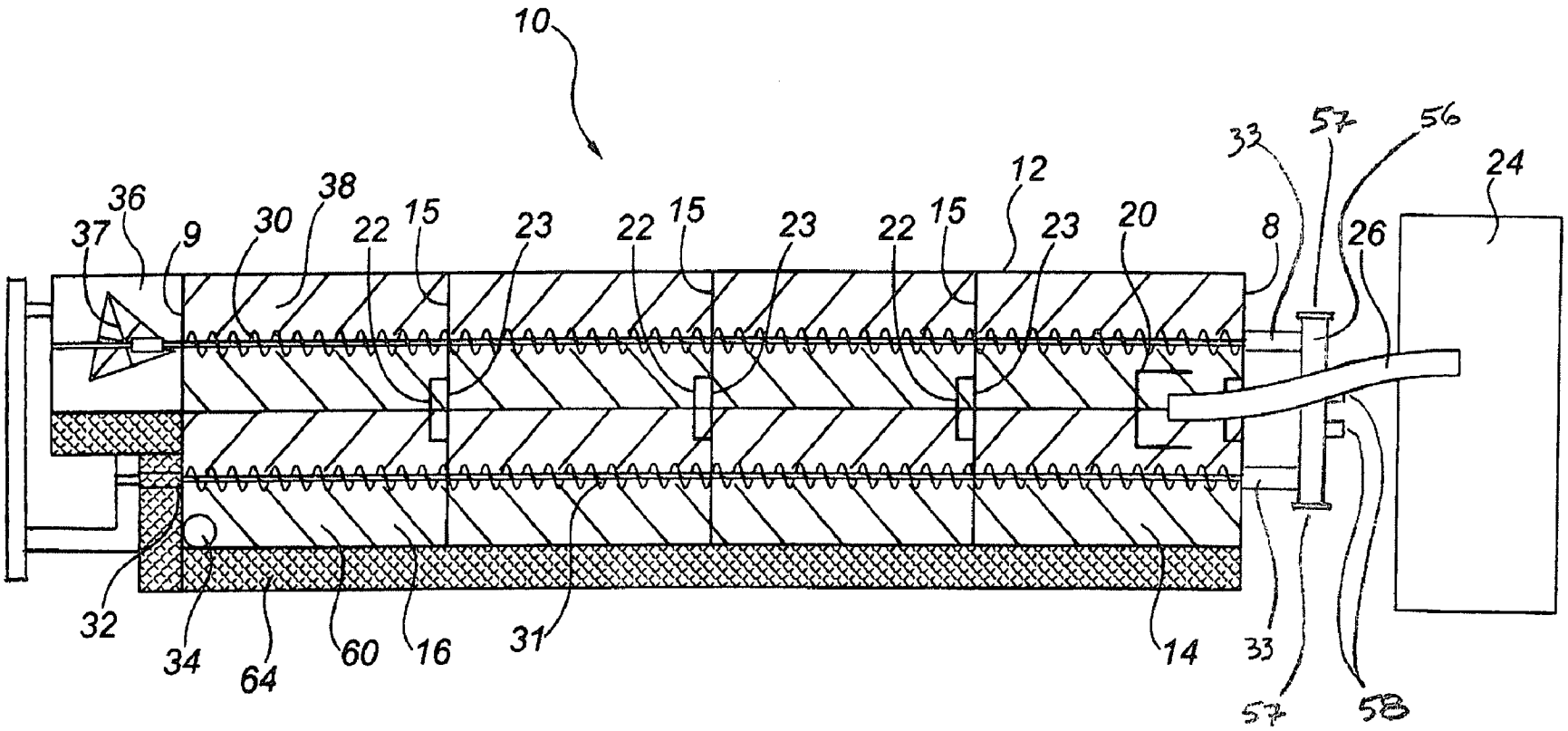
FIG. 2*b* is a top plan view depicting the settling tank of FIG. 1*a* having an auger that moves solids in the opposite direction as the fluid flow.
Figure 9:
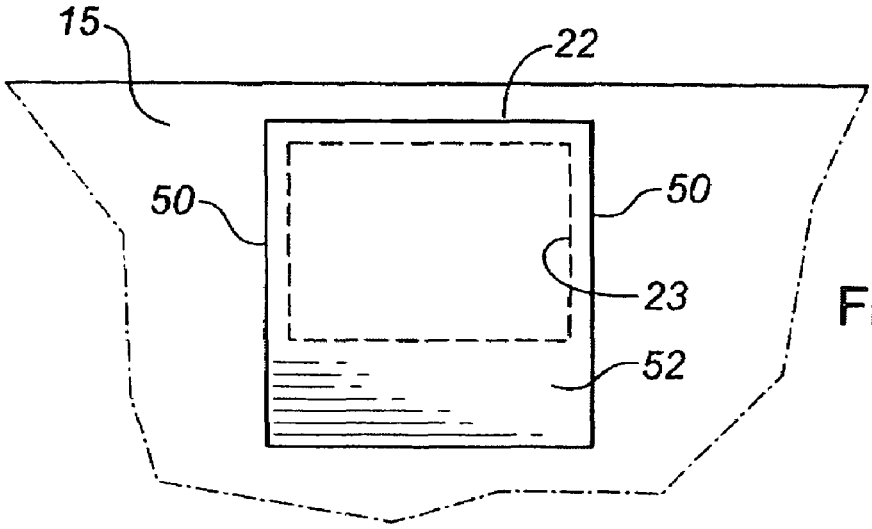
FIG. 9 is a front elevational view depicting the flow-restricting baffle of FIG. 1*a*.
Figure 10:
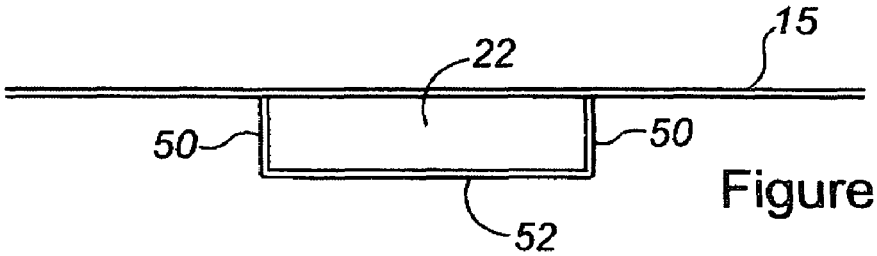
FIG. 10 is a top plan view depicting the flow-restricting baffle of FIG. 1*a*.
Figure 11:
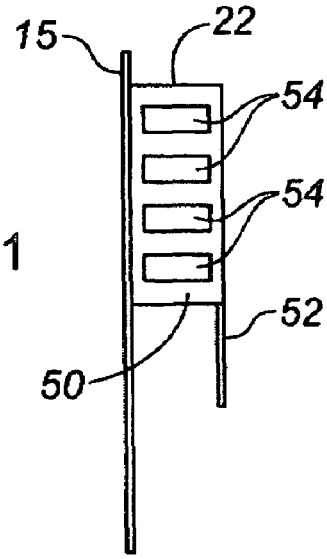
FIG. 11 is a side elevational view depicting the flow-restricting baffle of FIG. 1*a*.

Referring to FIG. 2*a*, tank 12 is shown having augers 30 and 31 configured to move solids in troughs 38 and 60 as material conveyors to move settled solids towards outlets 32 located on end wall 9. In this embodiment, augers 30 and 31 move solids in the same direction as fluid flowing through tank 12. Referring to FIG. 2*b*, tank 12 is configured having drive mechanism 28 located by end wall 9 such that augers 30 and 31 move solids towards outlets 32 located on end wall 8. In this embodiment, augers 30 and 31 move solids in a direction opposite to that of fluid flowing through tank 12.

Referring to FIGS. 4, 5, 6 and 7, barrier 20 has a vertical main back panel 46 and two vertical side panels 42 perpendicular to back panel 46 thereby forming a U-shaped structure. In one embodiment, back panel 46 can be approximately 34 inches high by 36 inches wide whereas each side panel 42 being can be approximately 34 inches high by 24 inches wide. Barrier 20 also has a bottom plate 44 between side panels 42 approximately 36 inches wide extending 12 inches from back panel 46 along the bottom edge of side panels 42. The top of barrier 20 is supported by support bar 40 that runs transverse across the top of tank 12. Bottom plate 44 sits on top of rib 62. Struts 41 that extend diagonally upward from rib 62 to the bottom edge of back panel 46 further support barrier 20. This results in the top of barrier 20 being approximately flush with the top of tank 12.

Within tank 12, transverse walls. 15 define and separate receiving compartment 14, intermediate compartments 18 and collecting compartment 16 within tank 12. On each transverse wall 15, there is an opening 23 located near or at the top of transverse wall 15. In one embodiment, opening 23 can be approximately 12 inches high by 18 inches wide. A flow-restricting baffle 22 can be mounted on the downstream side of each transverse 15 wall, aligned with opening 23 as shown in FIGS. 1*a* through 2*b*. Referring to FIGS. 8, 9, 10 and 11, baffle 22 is illustrated. In a representative embodiment, baffle 22 can be constructed from sheet steel and has a vertical back plate 52 approximately 28 inches high by 18 inches wide and two vertical side walls 50 perpendicular to back plate 52, each side wall 50 being approximately 24 inches high by 8 inches wide to form a U-shaped structure. Each side wall 50 of baffle 22 can have horizontal openings 54. In a representative embodiment, each side wall 50 comprises five horizontal openings 54 each approximately 6 inches wide by 2 inches high.

Referring back to FIGS. 1*a* through 2*b*, an embodiment of apparatus 10 can include mixing tank 36 attached to end wall 9 of tank 12. Contained in mixing tank 36 is mixer 37. Mixer 37 is mechanically coupled to auger 30 contained in trough 38 such that mixer 37 operates when auger 30 is driven by drive mechanism 28. Mixer 37 can be used to prepare a flocculating chemical agent that is used to assist in settling solids from the drilling fluid. In a representative embodiment of apparatus 10, drilling fluid is skimmed from collecting compartment 16, mixed with the chemical in mixer 37 and then pumped into receiving compartment 14 to mix with the received drilling fluid and assist in the settling of solids contained the drilling fluid. In another embodiment of apparatus 10, tank 12 includes walkway 64 mounted on a side wall 13 to permit an operator to inspect the fluid as passes through tank 12.

In operation, drilling fluid containing solids is pumped from holding tank 24 into receiving compartment 14 and directed towards flow-reversing barrier 20 via inlet 26. The flow of fluid is stopped by barrier 20 and reverses to flow around side panels 42. This causes heavier solids to settle into troughs 38 and 60 of tank 12. As the fluid level rises in receiving compartment 14, the fluid will overflow into the adjacent downstream intermediate compartment 18 through opening 23 in transverse wall 15 separating the two compartments. Fluid flowing through opening 23 encounters flow-restricting baffle 22 where the fluid will strike back plate 52 and deflect downwards to bottom 19 of tank 12. Fluid also passes through slots 54 in side walls 50 of baffle 22. The flow of fluid through baffle 22 causes further solids in the fluid to settle to the bottom of tank 12. Fluid flows from compartment to compartment by passing through successive baffles 22 in each transverse wall 15 until the fluid reaches collecting compartment 16. Fluid is withdrawn from collecting compartment 16 by pump 34 to be used again in the drilling operations.

Referring to FIG. 2*a*, solids that have settled to the bottom 19 of tank 12 are conveyed by augers 30 and 31 along troughs 38 and 60, respectively towards collecting compartment 16. Augers 30 and 31 expel a mixture or slurry of solids and fluid through outlets 32 on end wall 9 of tank 12. In the illustrated embodiment, outlets 32 are coupled to pipes 33 that can be 10 inches in diameter. Pipes 33 extend to intersect with plenum 56 also made of 10-inch diameter pipe. Plenum 56 has end covers 57 that are removable that allow for clean-out of plenum 56. Plenum 56 receives the slurry discharged from outlets 32 and directs the slurry to discharge ports 58. Ports 58 can be 4 inches in diameter and are connected via tubes, pipes or hoses (not shown) to a pump (not shown) to transfer the slurry to a centrifuge (not shown). The centrifuge is used to separate the residual fluid from the solids in the slurry, as well known to those skilled in the art. Fluid recovered from the centrifuge can be re-introduced into the tank at the receiving compartment to remove further residual solids or it can be re-used directly in the drilling operations.

Apparatus 10 as illustrated can accommodate a flow rate of drilling fluid in the range of 0 to 500 gallons per minute. It should be obvious to those skilled in the art that the size of tank 12 and the volume of each compartment is a function of the volume of drilling fluid to be recycled and the amount of solids that need to be removed from the fluids to facilitate their reuse. The size and dimensions of tank 12 can be scaled larger or smaller, accordingly, to suit the drilling operation the present invention is being used with. While the illustrated embodiments of apparatus 10 incorporate three transverse walls to form four compartments, fewer or more transverse walls may be installed in the settling tank to accommodate the volume of drilling fluid required for the drilling operations.

In another embodiment, either or both of flow-reversing barrier 20 and flow-restricting baffle can be part of a kit that can be installed or retro-fitted on an existing settling tank to improve the ability of removing solids from drilling fluid being passed through said tank. Barrier 20 can be installed in the receiving compartment of said tank using methods and additional materials obvious to persons skilled in the art to assist in the further removal of solids of drilling fluid introduced into the receiving compartment. Alternatively, or in addition to, baffle 22 can be installed on the downstream side of any apertures located on transverse walls disposed within said settling tank using methods and additional materials obvious to persons skilled in the art. By providing either or both of barrier 20 and baffle 22 in a kit, an existing settling tank can be upgraded to improve its ability to remove solids from drilling fluids.

Although a few preferred embodiments have been shown and described, it will be appreciated by those skilled in the art that various changes and modifications can be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. An apparatus for removing solids from drilling fluid, comprising:

a) a settling tank having first and second end walls, two side walls extending between the end walls and a bottom comprising at least one v-shaped trough running lengthwise between the end walls, the trough adapted to collect solids settled from the fluid, the tank forming a receiving compartment adjacent to the first end wall, a collecting compartment adjacent to the second end wall, and an outlet;

b) a substantially vertical barrier means for reversing the flow of a stream of drilling fluid containing solids received in the receiving compartment, said barrier means disposed in the receiving compartment and adapted to cause said stream to reverse direction and flow, around said barrier means thereby causing at least some of the solids contained in the fluid to settle to the bottom of the tank;

c) a wall transversely mounted in the tank between the side walls, the transverse wall separating the receiving and collecting compartments, the wall defining an aperture for allowing the fluid to pass through as the fluid flows in a first direction from the receiving compartment to the collecting compartment; and d) a material conveyor for moving the settled solids at the bottom of the tank towards the outlet.

2. The apparatus as set forth in claim 1 wherein said barrier means is disposed substantially central in the receiving compartment.

3. The apparatus as set forth in claim 1 wherein said barrier means comprises:

a) a substantially vertical back panel;

b) two side panels extending from the side edges of the back panel towards the first end wall; and c) a bottom plate extending from the bottom edge of the back panel towards the first end wall, the bottom plate extending between the side panels.

4. The apparatus as set forth in claim 1 further comprising at least one additional wall transversely mounted between the side walls thereby defining an at least one intermediate chamber between the receiving and collecting compartments, the at least one additional wall defining an aperture for allowing the fluid to pass through as the fluid flows in the first direction.

5. The apparatus as set forth in claim 1 wherein the material conveyor is an auger running lengthwise along the bottom of the trough, the auger driven by a drive mechanism, the auger capable of moving settled solids towards the outlet.

6. The apparatus as set forth in claim 5 wherein said outlet is located on said second end wall.

7. The apparatus as set forth in claim 6 wherein the bottom of the tank comprises two substantially parallel v-shaped troughs running lengthwise along the tank from the first end wall to the second end wall, the second end wall having two outlets, each outlet aligned with a trough, each trough having an auger driven by the drive mechanism, each auger capable of moving settled solids towards the second end wall and through an outlet.

8. An apparatus for removing solids from drilling fluid, comprising:

a) a settling tank having first and second end walls, two side walls extending between the end walls and a bottom enclosing the area defined by the bottom edges of the end walls and the side walls, the tank forming a receiving compartment adjacent to the first end wall, a collecting compartment adjacent to the second end wall, and an outlet;

b) a wall transversely mounted in the tank between the side walls, the wall separating the receiving and collecting compartments, the wall defining an aperture having a flow-restricting baffle, the baffle extending perpendicular from the wall into the collecting compartment, the baffle capable of causing at least some of the remaining solids contained in the fluid to settle to the bottom of the tank as fluid flows in a first direction from the receiving compartment to the collecting compartment and passes through the aperture and baffle; and c) a material conveyor for moving the settled solids at the bottom of the tank towards the outlet.

9. The apparatus as set forth in claim 8 further comprising at least one additional wall transversely mounted between the side walls thereby defining an at least one intermediate compartment between the receiving and collecting compartments, the at least one additional wall defining an aperture having a flow-restricting baffle, the baffle extending from the at least one additional wall towards the collecting compartment, the baffle capable of causing at least some of the remaining solids in the fluid to settle to the bottom of the tank as the fluid flows in the first direction through the aperture and baffle.

10. The apparatus as set forth in claim 9 wherein the baffle comprises a rectangular back plate parallel to the wall, the back plate spaced apart from the wall by two rectangular side walls extending perpendicular from the side edges of the back plate towards the wall and attached thereupon, each side wall defining a plurality of slot-shaped openings.

11. The apparatus as set forth in claim 8 wherein the bottom of the tank comprises a v-shaped trough running lengthwise along the tank from the first end wall to the second end wall, the trough adapted to collect solids settled from the fluid, the trough aligned with the outlet.

12. The apparatus as set forth in claim 11 wherein the material conveyor is an auger running lengthwise along the bottom of the trough, the auger driven by a drive mechanism, the auger capable of moving settled solids towards the outlet.

13. The apparatus as set forth in claim 12 wherein said outlet is located on said second end wall.

14. The apparatus as set forth in claim 13 wherein the bottom of the tank comprises two parallel v-shaped troughs running lengthwise along the tank from the first end wall to the second end wall, the second end wall having two outlets, each outlet aligned with a trough, each trough having an auger driven by the drive mechanism, each auger capable of moving settled solids towards the second end wall and through an outlet.

15. A method for recycling drilling fluid containing solids, comprising:

a) directing a stream of drilling fluid containing solids into a substantially vertical flow-reversing barrier located in a receiving compartment of a settling tank, the settling tank further comprising a collecting compartment, the collecting compartment separated from the receiving compartment by a transverse wall, the wall defining an aperture, the flow-reversing barrier capable of causing the stream to reverse direction and flow around the barrier thereby causing at least some of the solids contained in the fluid to settle to the bottom of the tank;

b) allowing the stream of fluid to fill the receiving compartment and pass through the aperture of the transverse wall as the fluid flows in a first direction from the receiving compartment to the collecting compartment;

c) allowing the fluid to flow in the first direction and fill the collecting compartment;

d) extracting fluid from the collecting compartment for re-use in drilling operations;

e) moving the settled solids on the bottom of the tank towards an outlet; and f) removing a mixture of fluid and solids from the outlet.

16. The method as set forth in claim 15 further comprising the step of flowing the fluid in the first direction through an aperture of at least one additional transverse wall, the at least one additional transverse wall located between the receiving compartment and the collecting compartment in the tank and defining at least one intermediate compartment.

17. The method as set forth in claim 15 further comprising the step of introducing an effective amount of a flocculating agent into the receiving compartment as the stream of drilling fluid containing solids is directed towards the flow-reversing barrier.

18. The method as set forth in claim 15 further comprising the step of passing the mixture of fluid and solids removed from the outlet through a centrifuge.

19. The method as set forth in claim 18 wherein the outlet is located on the second end wall and the settled solids are moved in the first direction towards the outlet.

20. A method for recycling drilling fluid containing solids, comprising:

a) directing a stream of drilling fluid containing solids into a receiving compartment of a settling tank, the settling tank further comprising a collecting compartment, the collecting compartment separated from the receiving compartment by a transverse wall, the wall defining an aperture with a flow-restricting baffle extending perpendicularly from the wall into the collecting compartment;

b) allowing the stream of fluid to fill the receiving compartment and pass through the aperture and flow-restricting baffle of the transverse wall as the fluid flows in a first direction from the receiving compartment to the collecting compartment, the flow-restricting baffle capable of causing at least some of the solids contained in the fluid to settle to the bottom of the tank as the fluid flows through the aperture and baffle;

c) allowing the fluid to flow in the first direction and fill the collecting compartment;

d) extracting fluid from the collecting compartment for re-use in drilling operations;

e) moving the settled solids on the bottom of the tank towards an outlet; and f) removing a mixture of fluid and solids from the outlet.

21. The method as set forth in claim 20 further comprising the step of flowing the fluid in the first direction through an aperture with a flow-restricting baffle of at least one additional transverse wall, the at least one additional transverse wall located between the receiving compartment and the collecting compartment in the tank and defining at least one intermediate compartment, the flow-restricting baffle capable of causing at least some of the remaining solids contained in the fluid to settle to the bottom of the tank as the fluid flows through the aperture and baffle.

22. The method as set forth in claim 20 further comprising the step of introducing an effective amount of a flocculating agent into the receiving compartment as the stream of drilling fluid containing solids is directed into said receiving compartment.

23. The method as set forth in claim 20 further comprising the step of passing the mixture of fluid and solids removed from the outlet through a centrifuge.

24. The method as set forth in claim 23 wherein the outlet is located on the second end wall and the settled solids are moved in the first direction towards the outlet.

25. A method for recycling drilling fluid containing solids, comprising:

a) directing a stream of drilling fluid containing solids into a substantially vertical flow-reversing barrier located in a receiving compartment of a settling tank, the settling tank further comprising a collecting compartment, the collecting compartment separated from the receiving compartment by a transverse wall, the wall defining an aperture with a flow-restricting baffle extending perpendicularly from the wall into the collecting compartment, the flow-reversing barrier capable of causing the stream to reverse direction and flow around the barrier thereby causing at least some of the solids contained in the fluid to settle to the bottom of the tank;

b) allowing the stream of fluid to fill the receiving compartment and pass through the aperture and flow-restricting baffle of the transverse wall as the fluid flows in a first direction from the receiving compartment to the collecting compartment, the flow-restricting baffle capable of causing at least some of the remaining solids contained in the fluid to settle to the bottom of the tank as the fluid flows through the aperture and baffle;

c) allowing the fluid to flow in the first direction and fill the collecting compartment;

d) extracting fluid from the collecting compartment for re-use in drilling operations;

e) moving the settled solids on the bottom of the tank in a second direction opposite the first direction towards an outlet located in the receiving compartment; and f) removing a mixture of fluid and solids from the outlet.

26. The method as set forth in claim 25 further comprising the step of flowing the fluid in the first direction through an aperture with a flow-restricting baffle of at least one additional transverse wall, the at least one additional transverse wall located between the receiving compartment and the collecting compartment in the tank and defining at least one intermediate compartment, the flow-restricting baffle capable of causing at least some of the remaining solids contained in the fluid to settle to the bottom of the tank as the fluid flows through the aperture and baffle.

27. The method as set forth in claim 25 further comprising the step of introducing an effective amount of a flocculating agent into the receiving compartment as the stream of drilling fluid containing solids is directed towards the flow-reversing barrier.

28. The method as set forth in claim 25 further comprising the step of passing the mixture of fluid and solids removed from the outlet through a centrifuge having an overflow and an underflow whereby the overflow produces an additional amount of fluid for re-use in drilling operations.

29. An apparatus for removing solids from drilling fluid, comprising:

a) a settling tank having first and second end walls, two side walls extending between the end walls and a bottom enclosing the area defined by the bottom edges of the end walls and the side walls, the tank forming a receiving compartment adjacent to the first end wall and a collecting compartment adjacent to the second end wall, the first end wall defining an outlet;

b) a substantially vertical flow-reversing barrier mounted in the receiving compartment, the barrier adapted to receive a stream of drilling fluid containing solids, the barrier capable of causing the stream to reverse direction and flow around the barrier thereby causing at least some of the solids contained in the fluid to settle to the bottom of the tank;

c) a wall transversely mounted in the tank between the side walls, the wall separating the receiving and collecting compartments, the wall defining an aperture having a flow-restricting baffle, the baffle extending perpendicular from the wall into the collecting compartment, the baffle capable of causing at least some of the remaining solids contained in the fluid to settle to the bottom of the tank as fluid flows in a first direction from the receiving compartment to the collecting compartment and passes through the aperture and baffle; and d) a material conveyor for moving the settled solids at the bottom of the tank towards the outlet on the first end wall.

30. The apparatus as set forth in claim 29 wherein the barrier is mounted substantially central in the receiving compartment, the barrier comprising:

a) a rectangular back panel, the panel parallel to the first end wall;

b) two rectangular side panels extending perpendicular from the side edges of the back panel towards the first end wall; and c) a rectangular bottom plate extending perpendicular from the bottom edge of the back panel towards the first end wall and extending between the side panels, the bottom plate affixed to the back panel and the side panels.

31. The apparatus as set forth in claim 29 further comprising at least one additional wall transversely mounted between the side walls thereby defining an at least one intermediate compartment between the receiving and collecting compartments, the at least one additional wall defining an aperture having a flow-restricting baffle, the baffle extending from the at least one additional wall towards the collecting compartment, the baffle capable of causing at least some of the remaining solids in the fluid to settle to the bottom of the tank as the fluid flows in the first direction through the aperture and baffle.

32. The apparatus as set forth in claim 31 wherein the baffle comprises a rectangular back plate parallel to the wall, the back plate spaced apart from the wall by two rectangular side walls extending perpendicular from the side edges of the back plate towards the wall and attached thereupon, each side wall defining a plurality of slot-shaped openings.

33. The apparatus as set forth in claim 29 wherein the bottom of the tank comprises a v-shaped trough running lengthwise along the tank from the first end wall to the second end wall, the trough adapted to collect solids settled from the fluid, the trough aligned with the outlet on the first end wall.

34. The apparatus as set forth in claim 33 wherein the material conveyor is an auger running lengthwise along the bottom of the trough, the auger driven by a drive mechanism mounted near the second end wall, the auger capable of moving settled solids towards the first end wall and through the outlet.

35. The apparatus as set forth in claim 34 wherein the bottom of the tank comprises two parallel v-shaped troughs running lengthwise along the tank from the first end wall to the second end wall, the first end wall having two outlets, each outlet aligned with a trough, each trough having an auger driven by the drive mechanism, each auger capable of moving settled solids towards the first end wall and through an outlet.

* * * * *

UNITED STATES PATENT AND TRADEMARK OFFICE

CERTIFICATE OF CORRECTION

PATENT NO. : 7,544,302 B2
APPLICATION NO. : 11/604098
DATED : June 9, 2009
INVENTOR(S) : Darin Merle Harding It is certified that error appears in the above-identified patent and that said Letters Patent is hereby corrected as shown below:

Title page, item (63) under Related U.S. Application Data: Please delete the incorrect reference to the parent patent as noted "Continuation-in-part of application No. 10/983,964, filed on Nov. 8, 2004, now Pat. No. 7,072,451." and replace with -- Continuation-in-part of application No. 10/983,564, filed on Nov. 8, 2004, now Pat. No. 7,160,474. --

Col. 1, line 6, delete "now U.S. Pat. No. 7,072,451." and replace with the correct patent number so that the text will read -- now U.S. Pat. No. 7,160,474. --

Signed and Sealed this

Twenty-eighth Day of July, 2009

John Doll

JOHN DOLL
*Acting Director of the United States Patent and Trademark Office*